US007921483B2

(12) United States Patent
Bonatz

(10) Patent No.: US 7,921,483 B2
(45) Date of Patent: Apr. 12, 2011

(54) PORTABLE ASSEMBLY BED AND KIT THEREFOR

(76) Inventor: Richard Bonatz, Duluth, GA (US)

( * ) Notice: Subject to any disclaimer, the term of this patent is extended or adjusted under 35 U.S.C. 154(b) by 0 days.

(21) Appl. No.: 12/777,536

(22) Filed: May 11, 2010

(65) Prior Publication Data

US 2010/0235984 A1 Sep. 23, 2010

Related U.S. Application Data

(62) Division of application No. 12/197,384, filed on Aug. 25, 2008, now Pat. No. 7,797,772.

(51) Int. Cl.
*A47C 19/00* (2006.01)

(52) U.S. Cl. ..... 5/9.1

(58) Field of Classification Search ..... 5/112, 110, 5/9.1, 8, 114
See application file for complete search history.

(56) References Cited

U.S. PATENT DOCUMENTS

| | | | | |
|---|---|---|---|---|
| 325,879 | A * | 9/1885 | Vuitton | 5/112 |
| 2,752,018 | A * | 6/1956 | Arlitt, Jr. | 190/21 |
| 4,597,122 | A * | 7/1986 | Handler et al. | 5/503.1 |
| 4,928,333 | A * | 5/1990 | Ewert | 5/110 |
| 6,401,995 | B1 * | 6/2002 | Yuille et al. | 224/404 |
| 6,938,288 | B2 * | 9/2005 | Hunter et al. | 5/114 |
| 7,325,264 | B2 * | 2/2008 | Holmes | 5/503.1 |
| 2005/0011002 | A1 * | 1/2005 | Hunter et al. | 5/9.1 |
| 2006/0260049 | A1 * | 11/2006 | Wenz | 5/503.1 |
| 2009/0113629 | A1 * | 5/2009 | Tucker | 5/485 |

* cited by examiner

*Primary Examiner* — Robert G Santos
*Assistant Examiner* — Brittany M Wilson
(74) *Attorney, Agent, or Firm* — Lackenback Siegel, LLP

(57) ABSTRACT

A kit for a portable assembly bed includes an operable carry bag having a carry grip and inner and outer surfaces bed construction components having cooperative means for assembly of the components, which components when assembled provide a bed for supporting at least one person.

28 Claims, 14 Drawing Sheets

PORTABLE ASSEMBLY BED AND KIT THEREFOR

PRIOR RELATED APPLICATIONS

This application is a divisional patent application of application Ser. No. 12/197,384, filed Aug. 25, 2008, now U.S. Pat. No. 7,797,772, and incorporates the priority application herein in its entirety and claims priority thereto.

BACKGROUND OF THE INVENTION

1. Field of Use of the Invention

This invention relates to a portable assembly bed. This invention also relates to a kit for the storage, transport and assembly of bed components. This invention also relates to components for a bed assembly particularly including a disc component construction. This invention further relates to a portable assembly for a double-decker bed construction including the storage and transport of the components.

2. Background and Discussion of the Prior Art

A collapsible bed is disclosed in U.S. Pat. No. 4,928,833, issued May 29, 1990 to Bonatz, which patent disclosure is incorporated herein in its entirety by reference thereto (the "Bonatz prior art construction"). The Bonatz prior art single bed construction included tubular frame members, a canvas bed and discs which when assembled formed a single bed. The Bonatz prior art construction was only operable as and suitable for a single bed function. Further, the Bonatz prior art construction components were difficult to transport.

It is a principal object of the present invention to provide a kit for the storage and transport of bed assembly components.

It is another principal object of the present invention to provide improved functionality for bed assembly components.

It is a further principal object of the present invention to provide an assembly for a double-decker bed or alternatively two single beds.

It is another object of the present invention to provide storage components for the assembled beds.

It is a further object of the present invention to provide a kit including carry bags for the ready transport of the components for the alternate assembly of a double-decker bed or two single beds.

The foregoing objects are achieved by the present invention.

SUMMARY OF THE INVENTION

The present invention, in one principal aspect, is a kit for the storage and transport of a bed assembly. The kit includes two carry bags with cooperable construction components in each bag, which components when assembled provide a double-decker bed or alternatively two single beds. The kit includes flexible material construction foot lockers for the ready assembly and disposition under the double-decker bed or separately under each single bed. The foot lockers are folded to a flat storage disposition. The construction components include novel heavy duty assembly discs and cooperable connectable tubular frame members. The head and foot assembly discs and tubular frame member constructions are pre-assembled and stowed as a kit in respective carry bags. The heavy duty discs have asymmetrically disposed reinforcing ribs in a specific disposition with respect to the connected tubular frame members. The double-decker bed has two unfolded foot lockers disposed beneath the lower bed and an accessories pouch removably attached to and depending from the lower bed frame. The carry bags with the bed assembly components stowed therein are readily carried from one location to another for ready assembly of the double-decker bed or two single beds. The present kit construction and bed assembly is particularly useful in, but not limited to, military applications.

DESCRIPTION OF THE INVENTION

Figure 1:
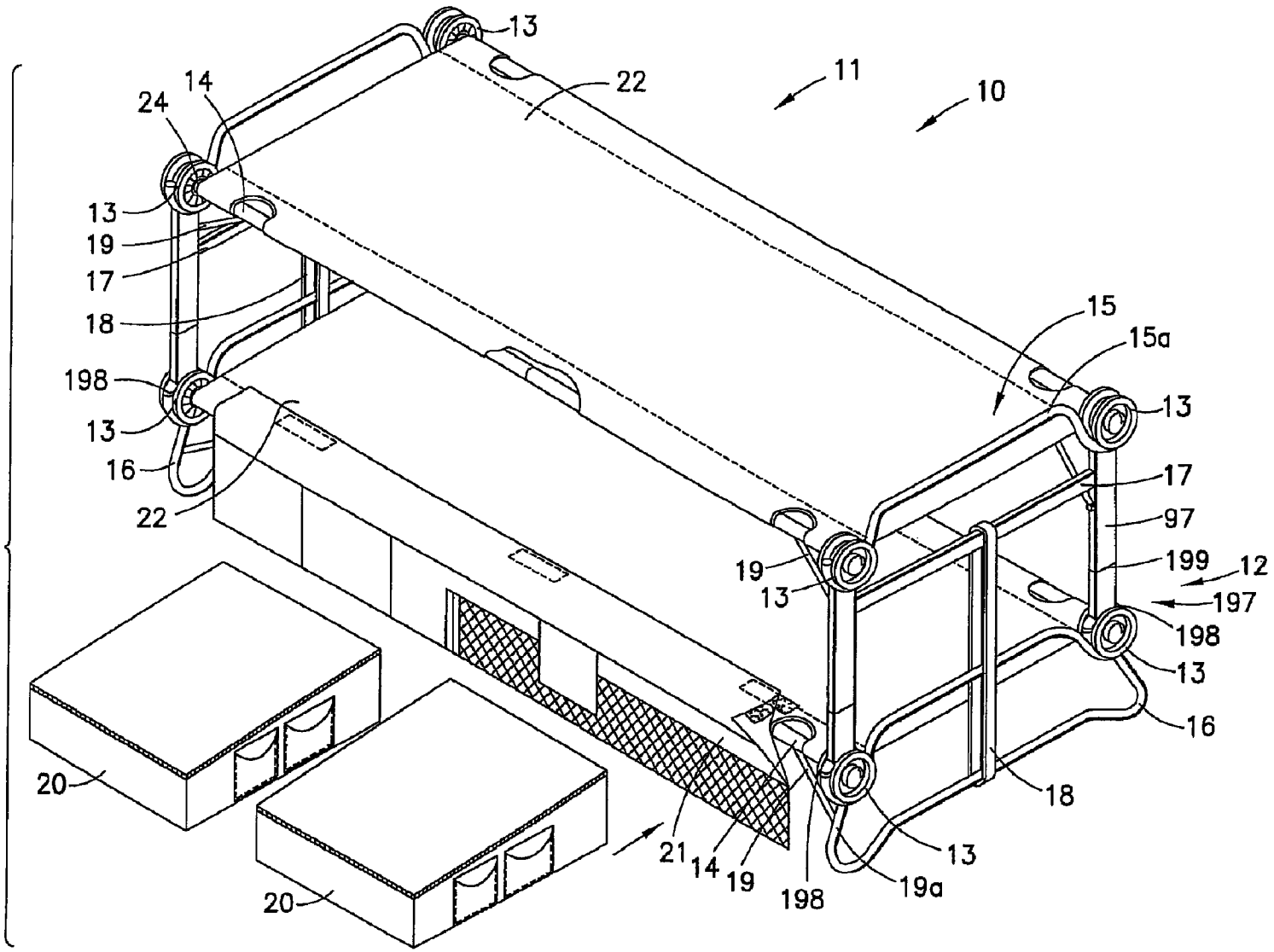
FIG. 1 is a front perspective partial assembly view of the double-decker bed of the present invention.

Referring to FIG. 1, there is shown the double-decker bed or bed assembly 10 of the present invention. Bed 10 includes an upper bed or cot 11 and a lower bed or cot 12. The bed construction in general includes eight assembly discs 13, four tubular assembly side members or assemblies 14, two upper bed tubular head assembly 15, has lower bed head and foot assemblies 16, two horizontally disposed cross members or supports 17, two vertically disposed integrating connecting straps 18, four angularly disposed reinforcing struts 19, and two canvas or like flexible material bed support pieces 22. A pair of foot lockers 20 and a hanging accessories pouch 21, in general, completes the double-decker bed assembly 10, as will be more fully discussed hereinafter.

Figure 2:
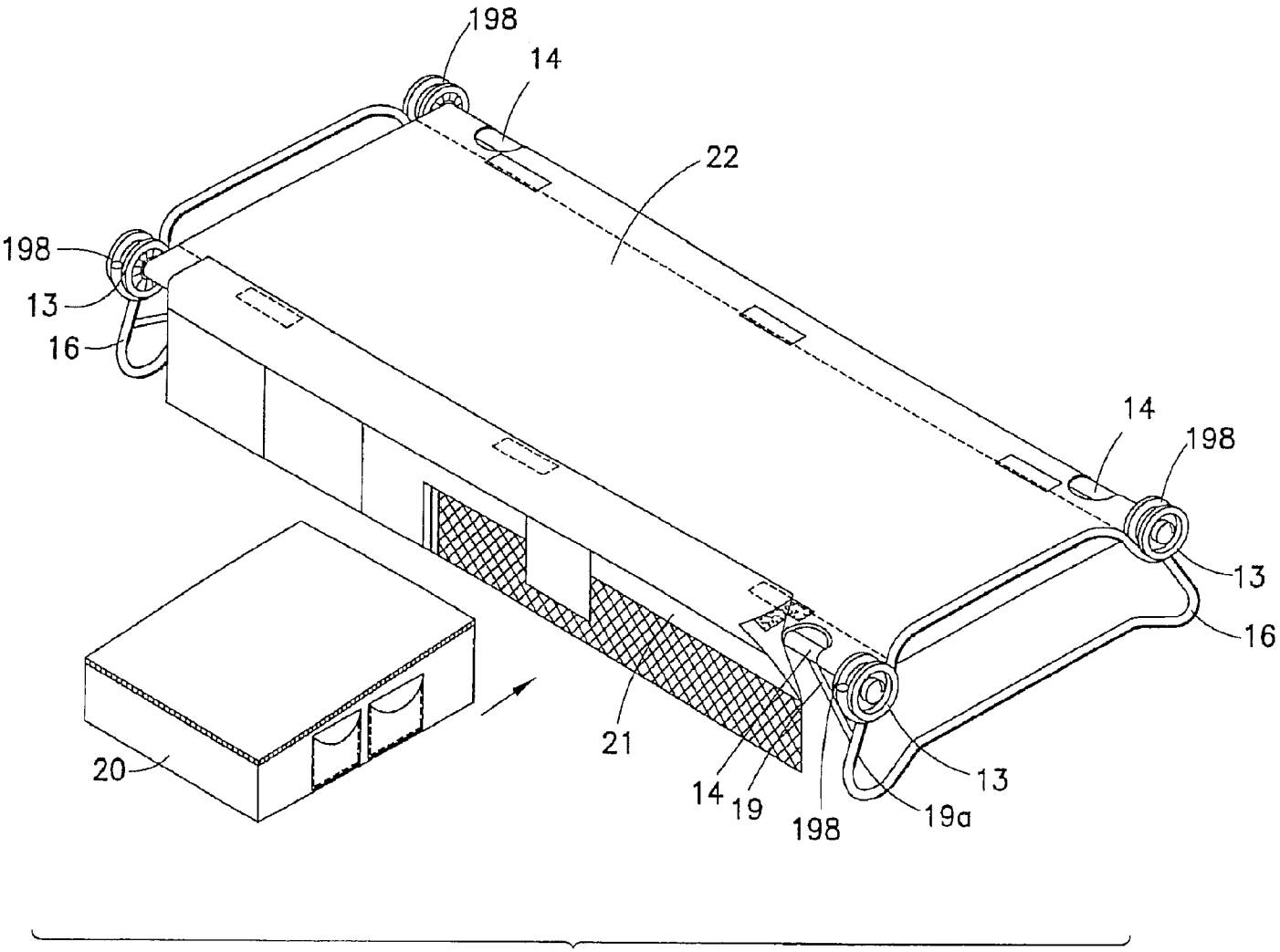
FIG. 2 is a front perspective partial assembly view of the single lower bed.

Referring to FIG. 2, there is shown the lower bed or cot 12 in the single bed disposition. Bed 12 has four assembly discs 13 and two tubular foot assemblies 16 and two tubular frame assemblies 14 interconnected with canvas support piece 22 to in general from the assembled single lower bed 12. One foot locker 20 is slidably disposed under the bed. Accessories pouch 21 is Velcro® attached to the flexible cover 22 portion surrounding tubular frame assembly 14.

Figure 3:
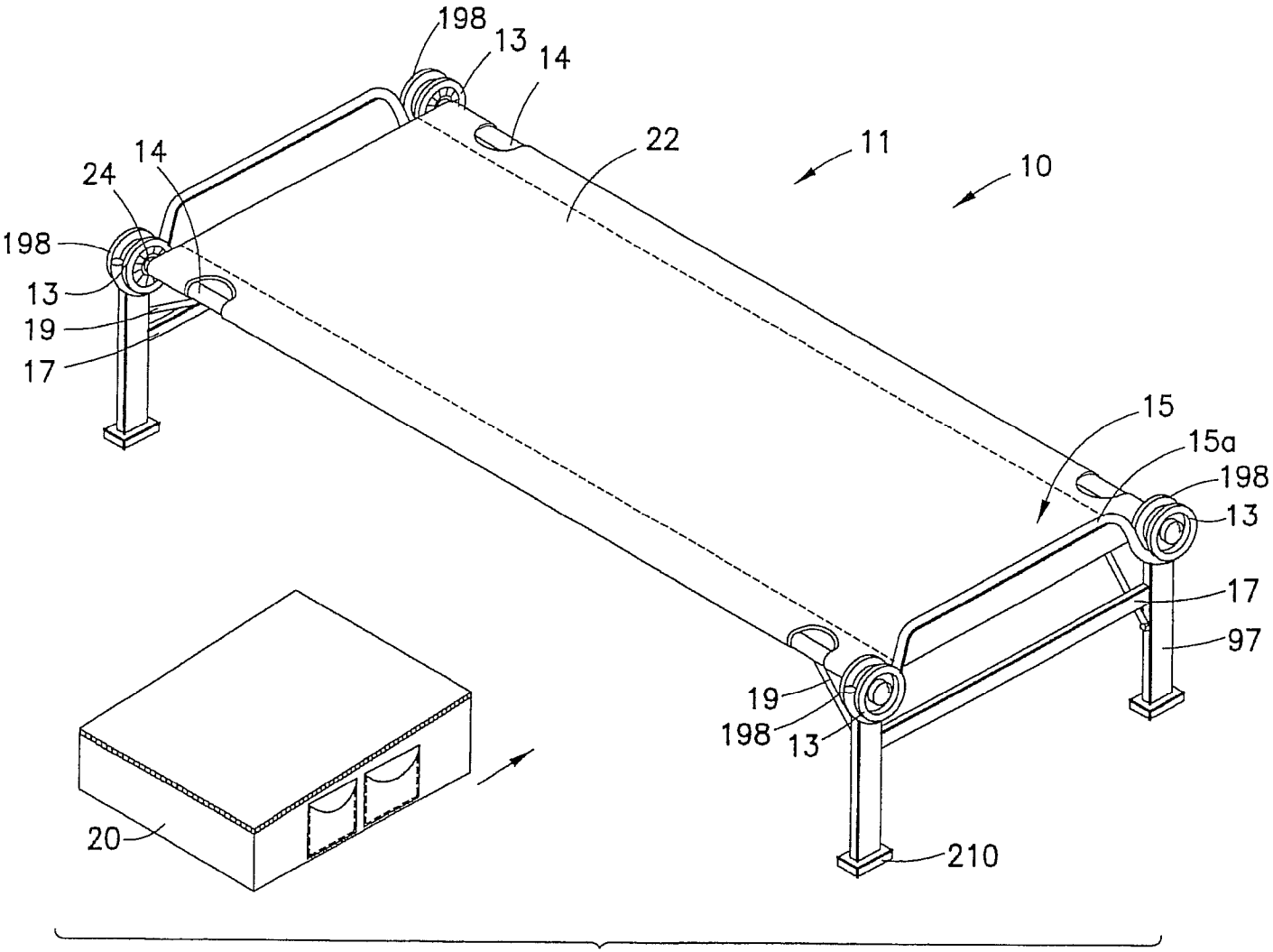
FIG. 3 is a front perspective partial assembly view of the single upper bed.

Referring to FIG. 3, there is shown upper bed or cot 11 in the single bed disposition. Bed 11 has four assembly discs 13, two tubular assemblies 15, two tubular frame assemblies 14 with canvas support piece 22 to in general form the assembled single (upper) bed 11. Tubular assemblies 15 include lock cylindrical tubular members 15*a* and conjoined rectilinear tubular members 17 and 97. One foot locker 20 is slidably disposed under the bed. Foot pads 210 cap the rectilinear ends of vertically disposed tubular members 97.

Referring again to FIG. 1, lower support member 197 inter-fittingly engages depending tubular frame member 97 as at 199. Lower support members also include depending semi-circular tubular end piece 198 which slidably inter-fits within the annular circumferential recess or track of lower disc 13. Integrating or locking strap 18 surrounds bottom tubular frame member 78 and upper tubular frame member 15*a* and the tighten strap 18 provides a locking tension force between lower assembly 16 and upper assembly 15.

Figure 12:
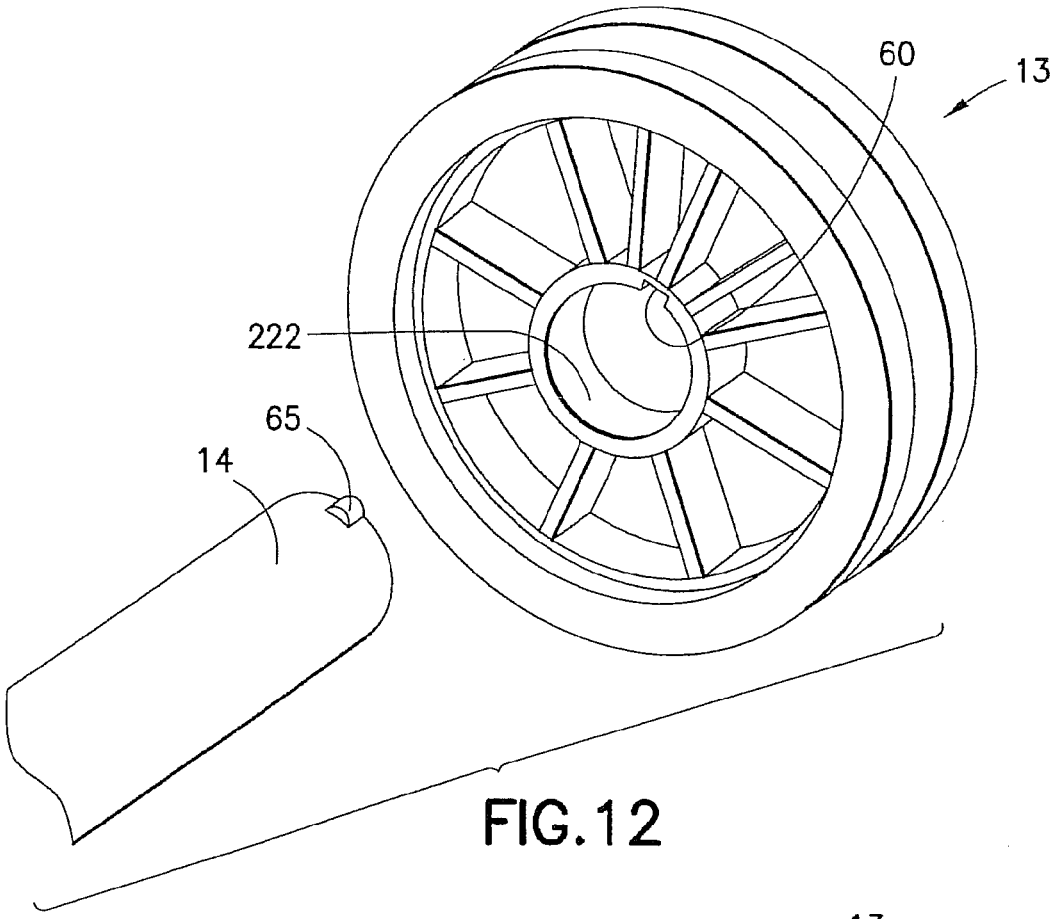
FIG. 12 is a perspective view of the assembly disc of FIG. 9 and a tubular frame member in the unassembled position.
Figure 13:
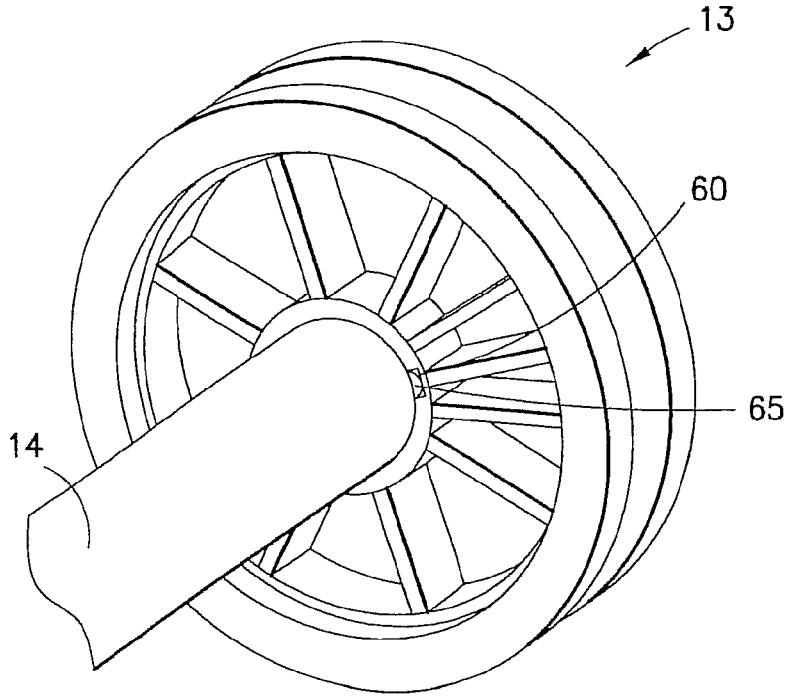
FIG. 13 is the assembly disc and tubular frame member of FIG. 12 in the assembled position.

The tubular frame members 14 (FIGS. 17-18) are inter-fitted and then passed through canvas support opening 221, and then forced-filled into the circular hub 222 of discs 13 (FIGS. 1, 12-13). Similarly, the tubular inter-fitting of lower support member 97 with and between upper assembly 15 and lower assembly 16 is likewise readily accomplished. Stabilizer bars 19 are also readily clipped onto stabilizer pin 19*a*, to stabilize the assembled double-decker cot.

Figure 4:
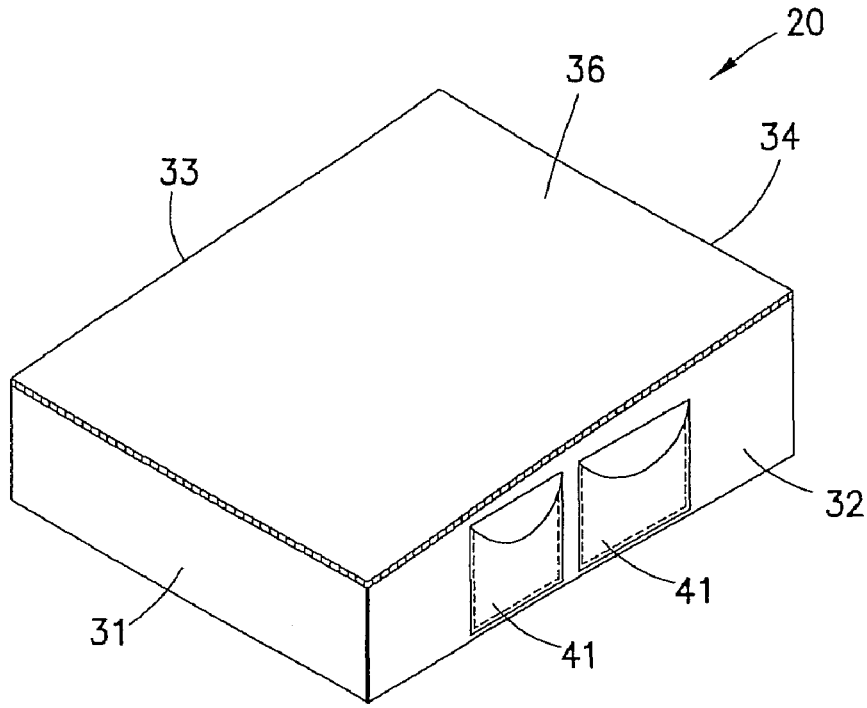
FIG. 4 is a front perspective view of one foot locker in the closed position.
Figure 5:
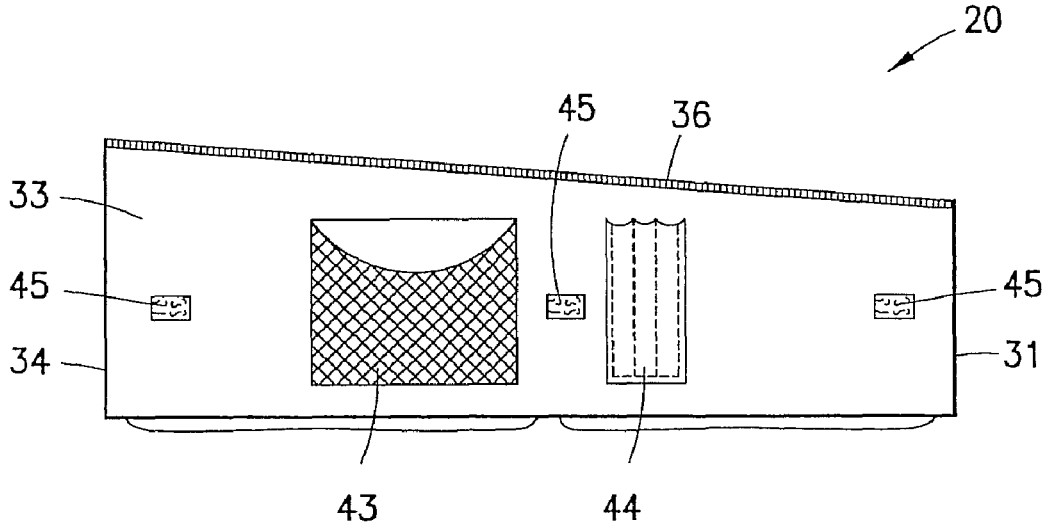
FIG. 5 is a side elevational view of the foot locker as shown in FIG. 4.
Figure 6:
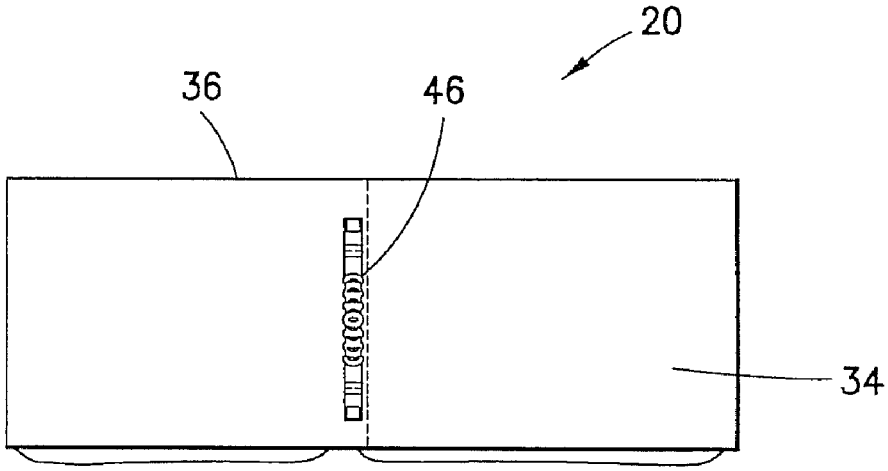
FIG. 6 is a rear elevational view of the foot locker of FIG. 4.
Figure 7:
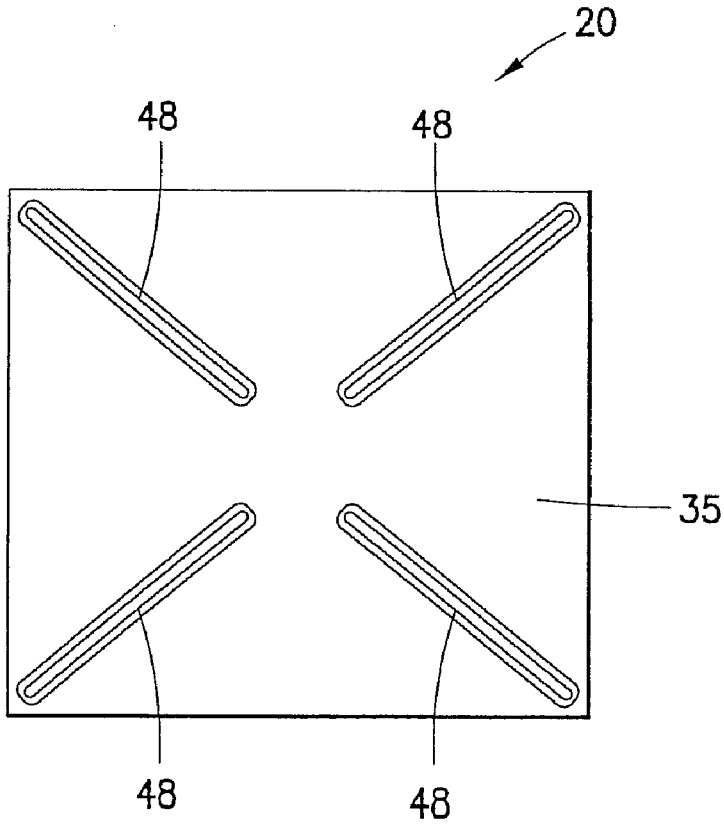
FIG. 7 is a bottom plan view of the foot locker of FIG. 4.
Figure 8:
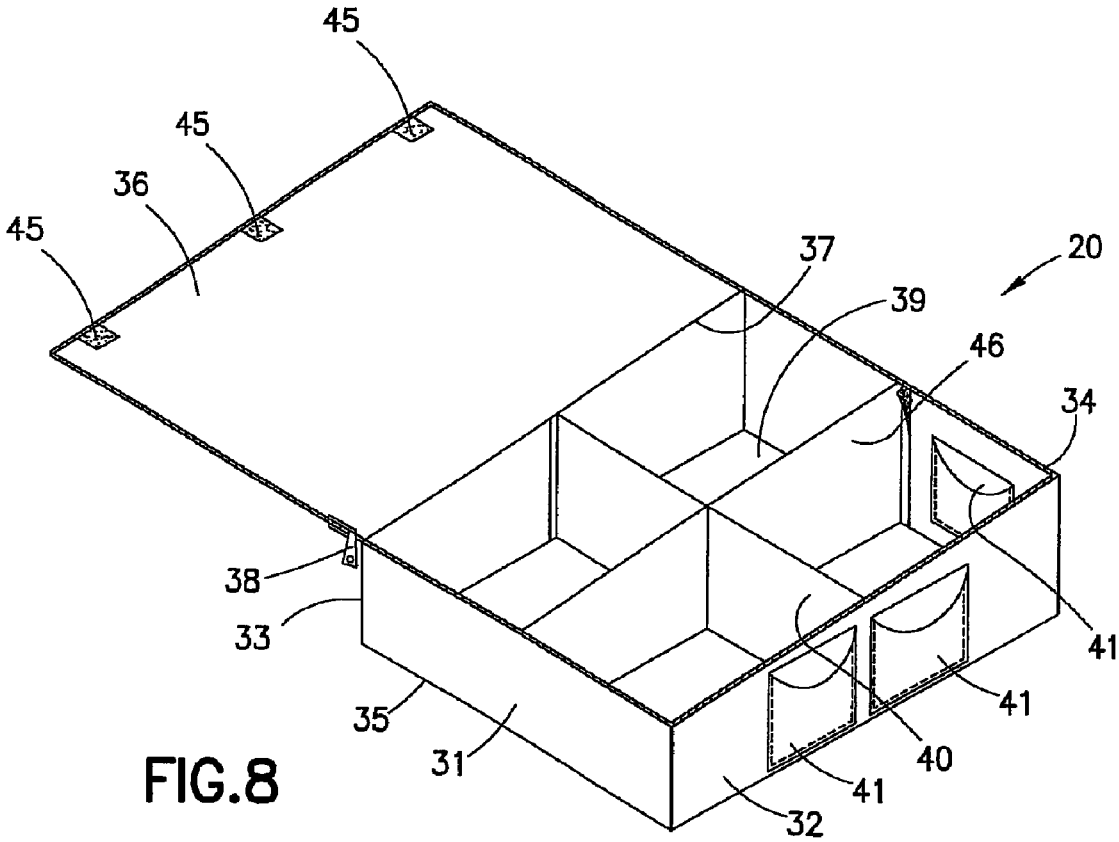
FIG. 8 is a front perspective view of the foot locker of FIG. 4 in the open position showing the assembled partitions.
Figure 8A:
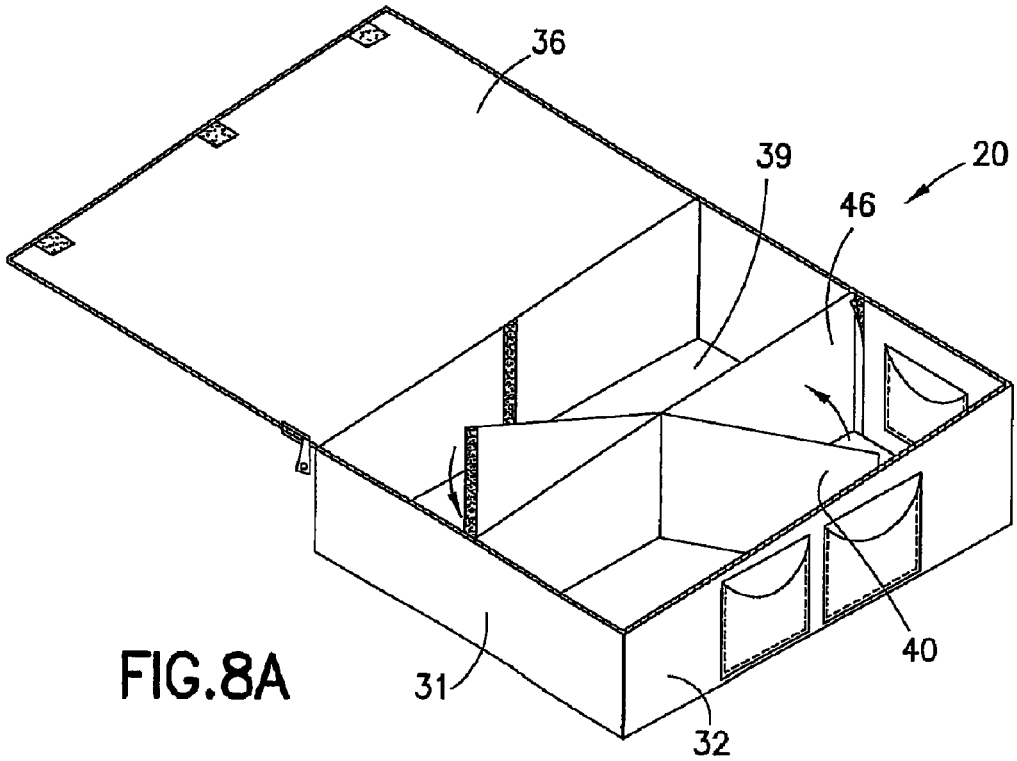
FIG. 8A is the foot locker as shown in FIG. 8 showing the foldable disassembly of the partitions.
Figure 8B:
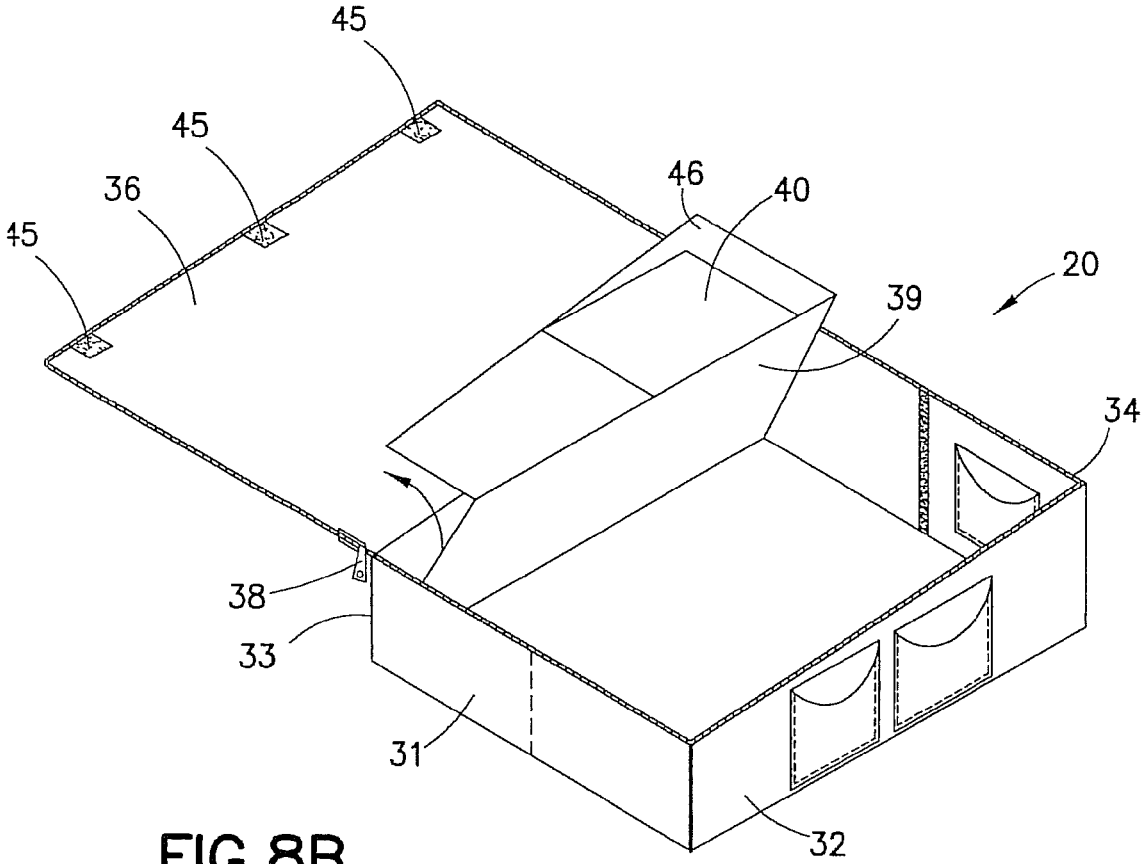
FIG. 8B is the foot locker as shown in FIG. 8 showing the initial foldable disassembly of the foot locker.
Figure 8C:
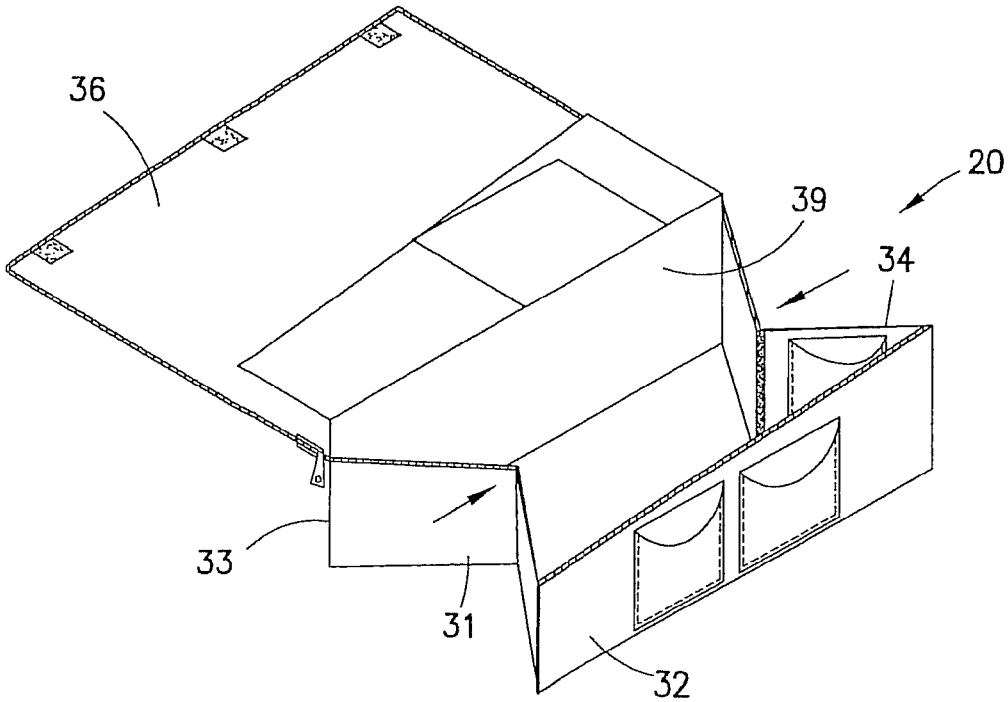
FIG. 8C is the front foot locker as shown in FIG. 8B showing the further foldable disassembly of the foot locker.
Figure 8D:
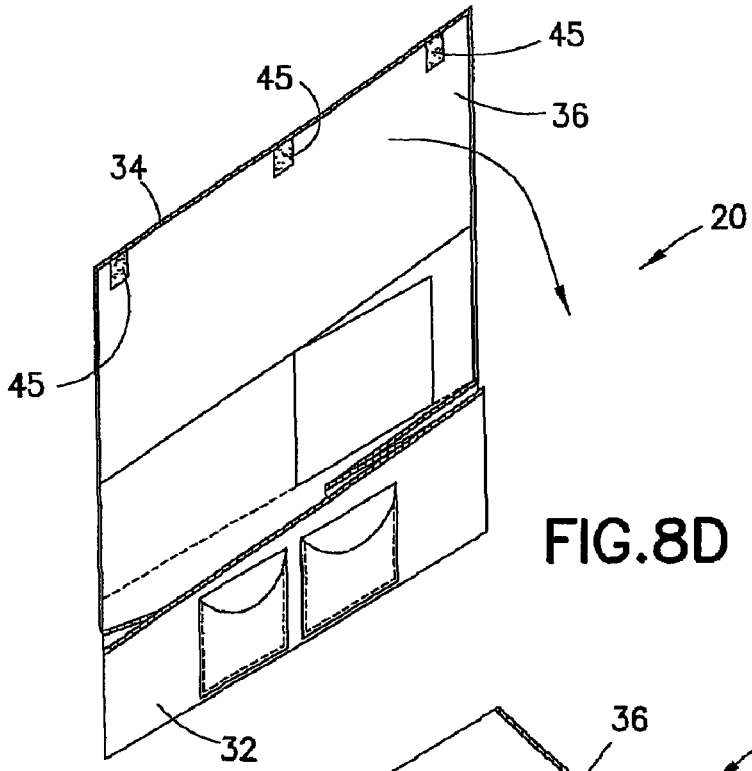
FIG. 8D is the foot locker as shown in FIG. 8C showing the further foldable disassembly.
Figure 8E:
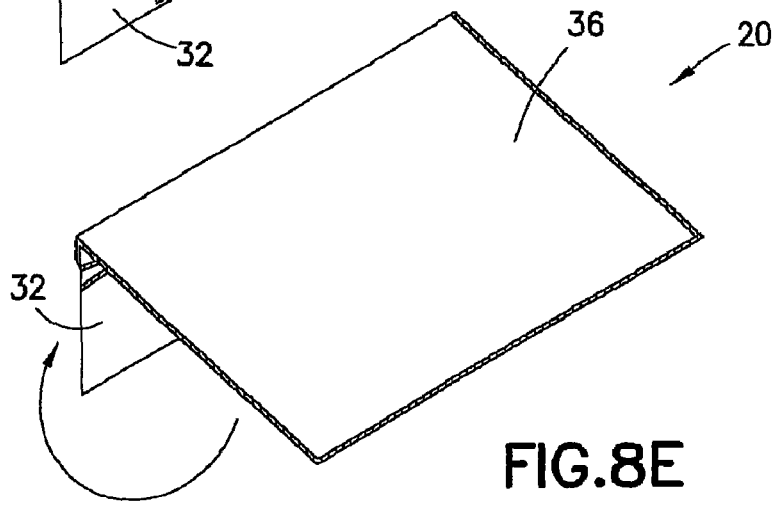
FIG. 8E is the foot locker as shown in FIG. 8D showing the still further foldable disassembly.
Figure 8F:
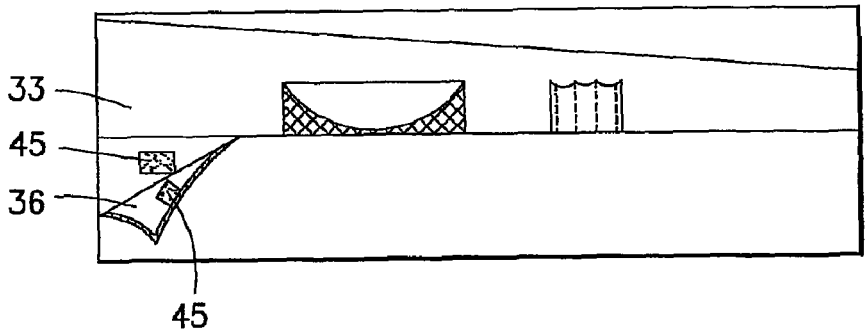
FIG. 8F is the foot locker as shown in FIG. 8E in the fully folded flat disposition.
Figure 9:
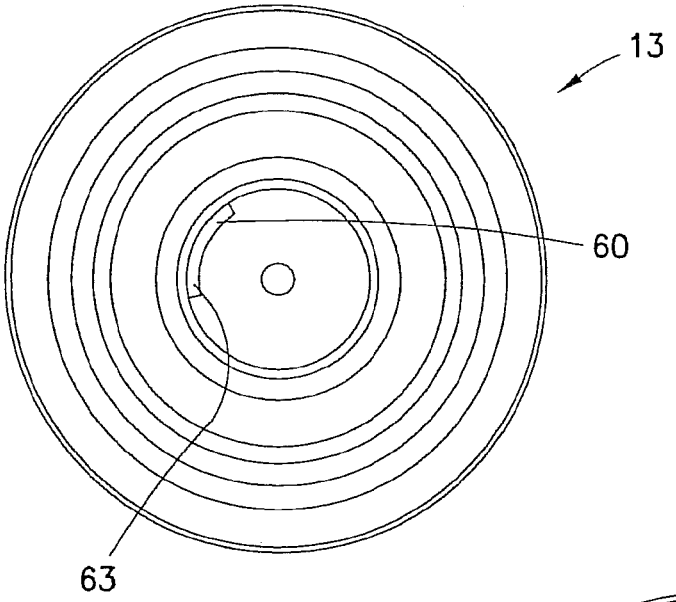
FIG. 9 is a front elevational view of the assembly disc of the present invention.
Figure 10:
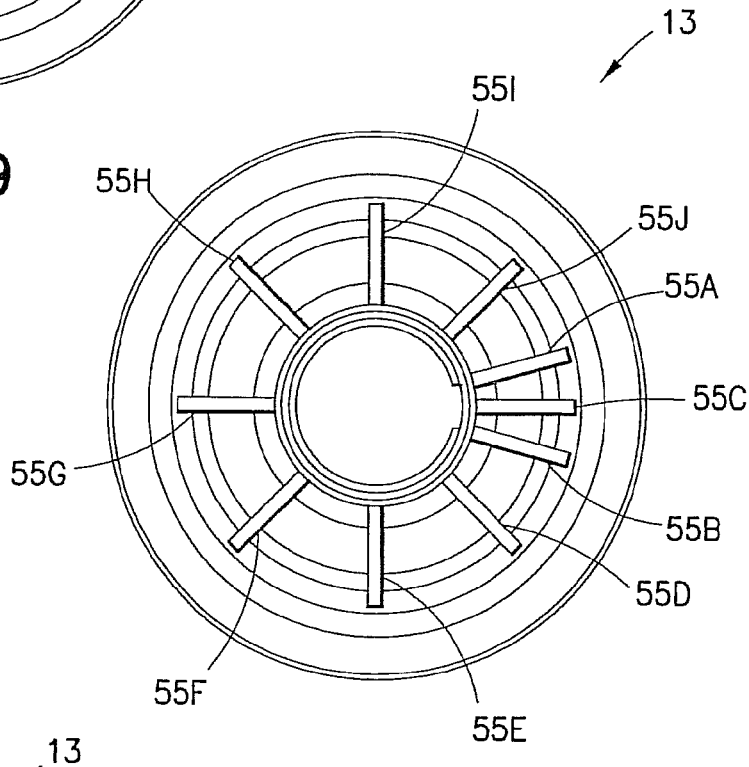
FIG. 10 is a rear elevational view of the assembly disc of FIG. 9.
Figure 11:
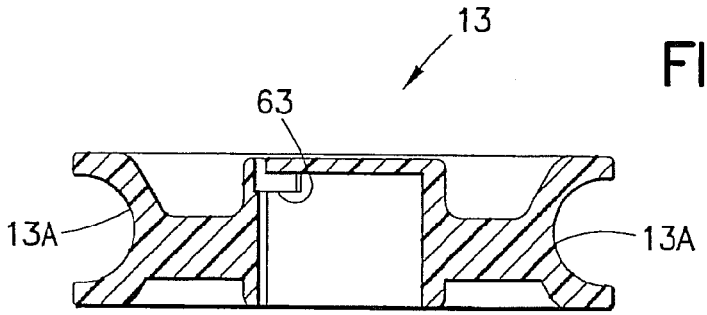
FIG. 11 is a sectional view of the assembly disc of FIG. 9.

Referring to FIGS. 4-7 and 8-8F, there is shown foot locker 20. Foot locker 20 is generally of the flexible material foldable construction. Foot locker 20 includes front 31, sides 32 and 33, rear 34, bottom 39 and openable top 36. Top 36 is hinged to side 33 as at 37. Velcro® pads 45 secure top 36 in the closed position (FIGS. 4 and 8). The inside bottom portion 39 of foot locker 20 includes assembled vertically disposed partitions 46. Partitions 46 are Velcro® pad secured to the inner walls of foot locker 20 (FIG. 8). Partitions 46 are of foldable disassembly construction together with bottom 39 (FIGS. 8A-8C). Flexible material pockets 41 (typical) are fixedly secured or sewn on the outside wall of side 32. Side 33 includes net construction storage pocket 43, elongate item storage pocket 44 and Velcro® pads 45 (typical (FIG. 5). Pads 45 attach to other cooperatively disposed pads such as on a second foot locker or to carry bag pads when in the folded stowed construction for ready transport. Rear 34 includes flexible handle 46 for ready transport of the foot locker 20 with or without its contents (FIG. 6). Bottom surface 35 includes four thermoplastic reinforcing ribs 48 fixedly glued or thermoplastically bonded to bottom surface 35 to support the upright foot locker 20 on a floor surface.

Foot locker 20 is readily folded in a step wise manner to a fully folded flat disposition (FIGS. 8A-8F) for ready for transport in the carry bag, as will be more fully discussed hereinafter.

Figure 14:
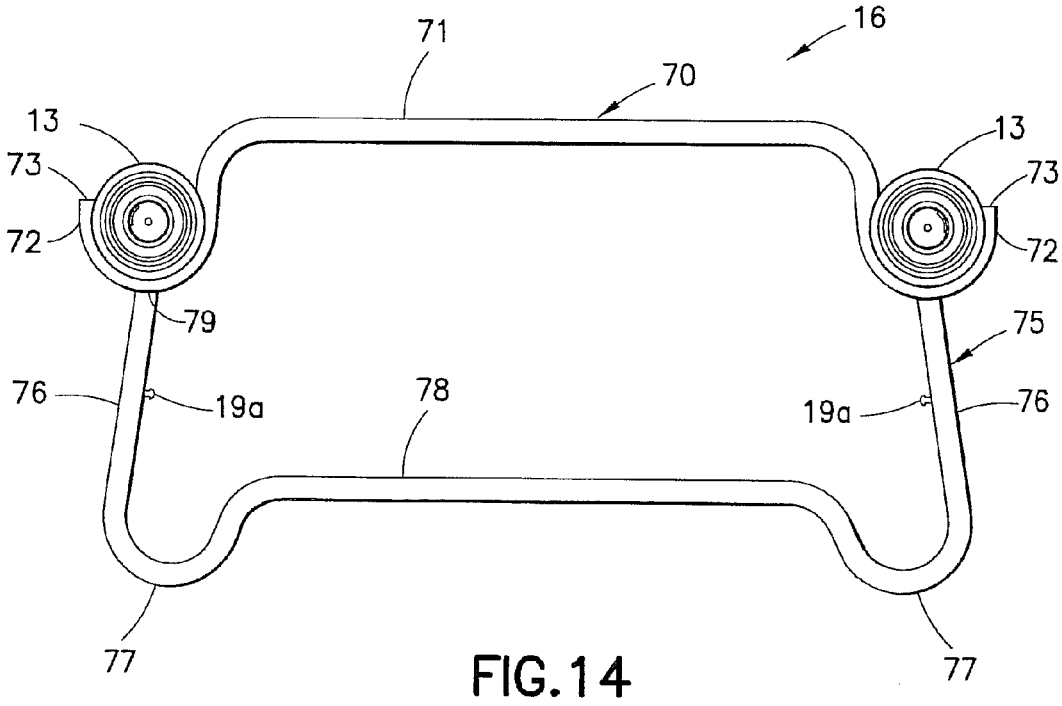
FIG. 14 is an outer side elevational view of the frame member and disc construction of the lower bed.
Figure 15:
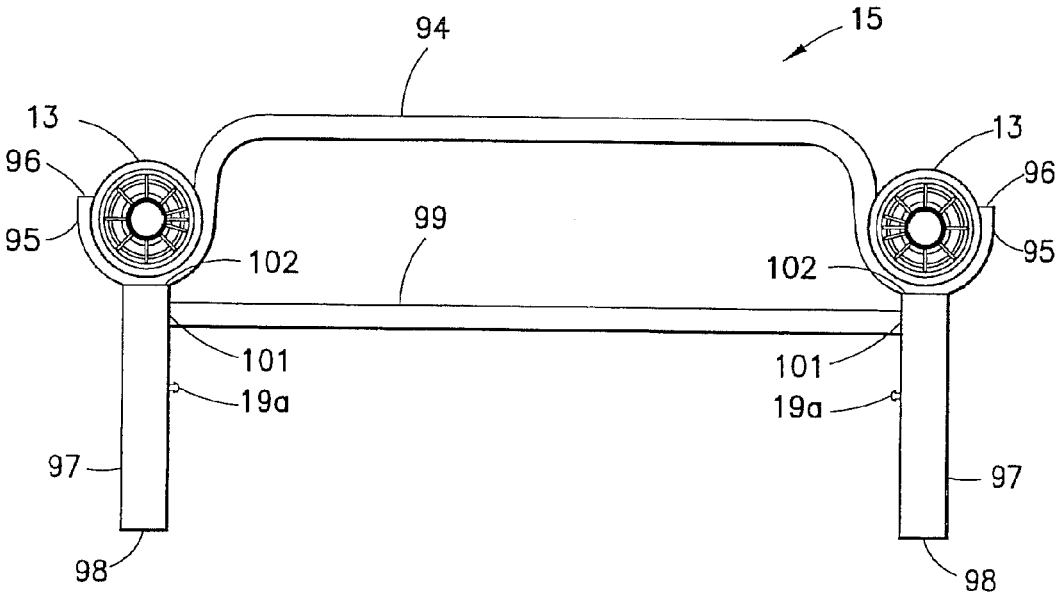
FIG. 15 is an inner side elevational view of the frame member and disc construction of the upper bed.
Figure 16:
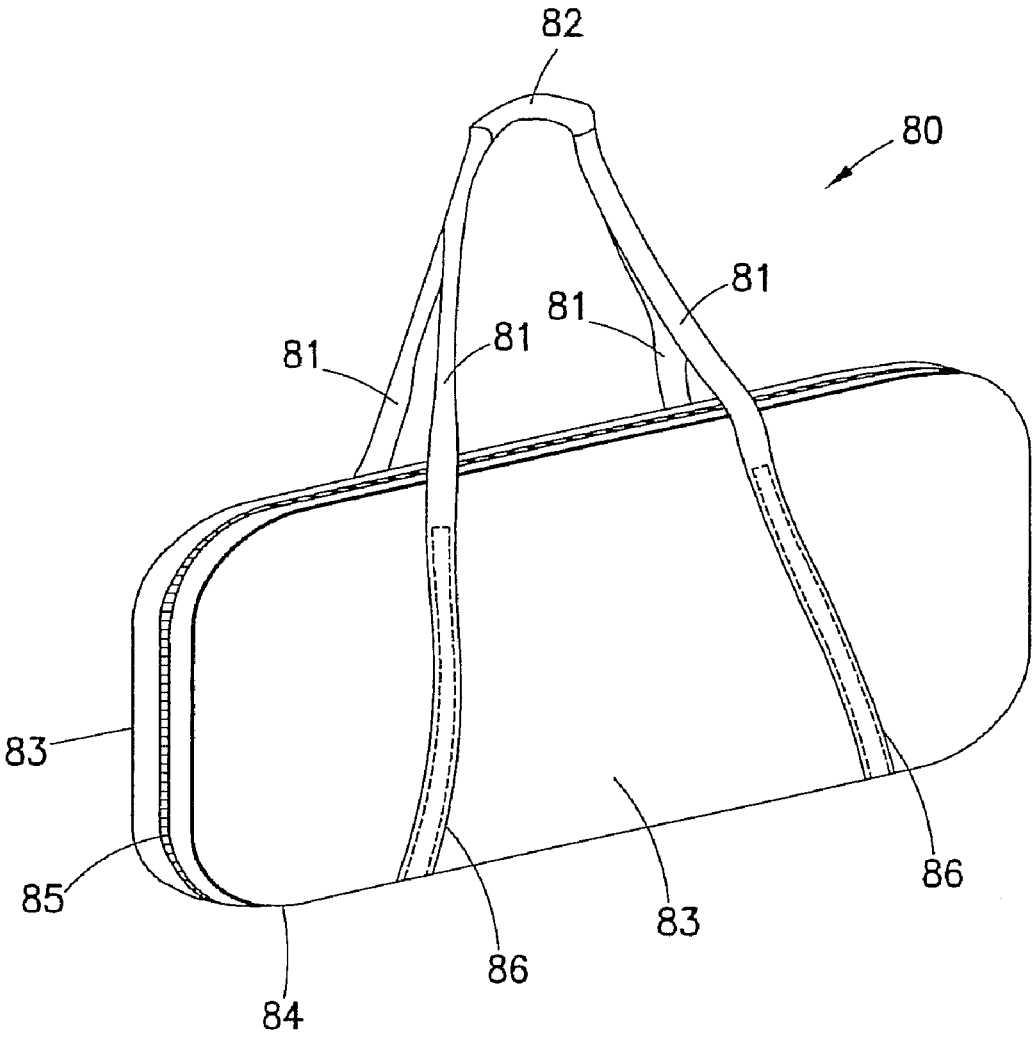
FIG. 16 is a front perspective view of one of the two carry cases in the closed position.

Referring to FIGS. 9-13, there is shown assembly disc 13. Disc 13 including central hub 222, peripheral concave seat 13A and a plurality of ribs 55A-55J. Ribs 55A-55J are asymmetrically disposed. Ribs 55A and 55B are immediately oppositely juxtaposed to one rib 55C. Ribs 55A-55B are not radially disposed. Ribs 55C-55J are symmetrically radially disposed. The specific asymmetrical construction 55A-55B is juxtaposed to and straddles partial circumferential slot 60. Slot 60 is sized to receive locking cam or wing 65 of tubular member or assembly 14. In this manner of construction, tubular member wing 65 engages slot 60 and is rotated in race 63 to a locked position. The asymmetrical rib construction 55A-55C maintains the integrity and operability of the interconnected metal tubular member 14/wing 65 disposed in thermoplastic disc slot 60/race 63 construction, as well as providing durability in heavy duty use. Tubular member 14 is preferably formed of two inter-fitted swaged tubular frame members for improved support strength in heavy duty environments. The foregoing constructions are particularly useful in military environments Referring to FIGS. 14-15, there is shown the pre-assembled foot assembly 16 (FIG. 14) and pre-assembled head assembly 15 (FIG. 15). Foot assembly 16 includes integral tubular assemblies 70 and 75 and two inter-fitted discs 13. Tubular assembly 70 is formed of a horizontally disposed cross member 71 with semi-circular portions or wings 72 having circular ends 73. Tubular foot support 75 includes downwardly outwardly disposed legs 76 with curvilinear tubular feet 77 and bottom tubular cross piece 78 of integral construction. Tubular foot support 75 is integrally bonded or welded to tubular assembly at 79. A pair of stabilizer pins 19*a* for connection to stabilizers 19 (FIG. 1). Disc 13 and particularly annular circumferential recessed seats or tracks 13A are force fitted into wings 72. Disc 13 as assembled to integral assemblies 70 and 75 forms foot assembly 16. Foot assembly 16 as shown in FIG. 14 is readily stowed in a carry case.

Referring specifically to FIG. 15, there is shown head assembly 15. Head assembly 15 includes tubular cross member 94 with outwardly dispose semi-circular wings 95 having circular ends 96, and downwardly vertically disposed rectilinear tubular members 97 terminating in rectilinear end 98. A cross-piece 99 interconnects and braces members 97. Stabilizer pieces 19*a* are disposed at one end on member 97. Foot pads 210 (FIG. 3) are clipped onto ends 98 of members 97 to provide a protective bearing surface for the floor. Head assembly 15 is of integral bonded or welded construction as at 101 and 102. Disc 13 is force fitted onto semi-circular ends 95, in a manner similar to that for foot assembly 16. Head assembly 15 as shown in FIG. 15 is readily stowed in a carry case.

Figure 17:
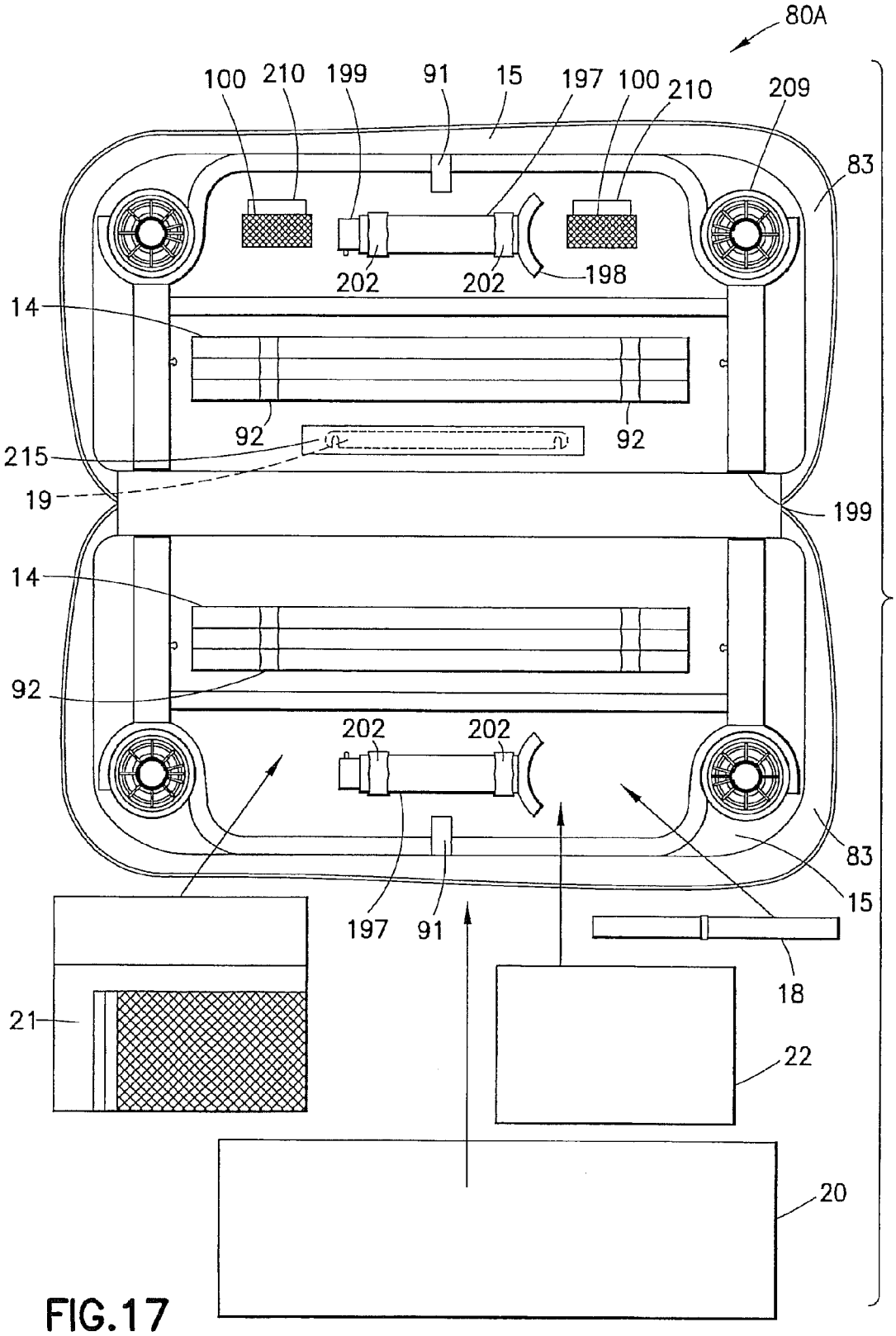
FIG. 17 is a plan view of one carry case in the open position principally showing the upper bed assembly construction.

Referring to FIG. 17, there is shown carry case 80. Carry case 80 is formed of flexible material or fabric. Case 80 includes straps 81 and handle 82. Carry case 80 includes panels or sides 83, hinge 84 and zipper 85 which selectively encloses sides 83. Straps 81 are stitched or bonded to sides 83 as at 86. Carry case 80 is provided in two embodiments 80A and 80B, respectively, for the head assemblies (FIG. 17) and foot assemblies 16 (FIG. 18) as well cooperating construction elements. In this manner of construction, the two carry cases 80A and 80B contain all the construction components and elements required to assemble the double-decker bed or cot 10. A person of average strength can readily transport both fully complemented carry cases 80A and 80B to a location and readily assemble the double-decker cot 10.

Referring specifically to FIG. 17, there is shown carry case 80A. Carry case 80A contains two head assemblies 15, held in place by Velcro® tab straps 91. A plurality of inter-fitting tubular members 14 are retained in place on the inside of panel 83 by straps 92. Lower support members 197 include part-circular tubular end piece 198 for engaging disc 13 as at 201. Members 197 are held in place by retainers 202.

Netted pockets 100 are fixedly secured to the inside of carry case panel 83. Rectilinear plastic footings 210 are held in net pockets 100. Footings 210 frictionally fit onto tubular member 97 at 199 when the upper bed is utilized as a singled bed in contradistinction to the double-decker construction. A plurality of stabilizer bars 19 are retained in elongate pocket or sleeve 215.

The folded accessories bag 21 is stowed between the folded case panels 83. The folded foot locker 20 is stowed between the folded case panels 83. The integrating or locking strap 18 is also stowed between the folded case panels 83.

Figure 18:
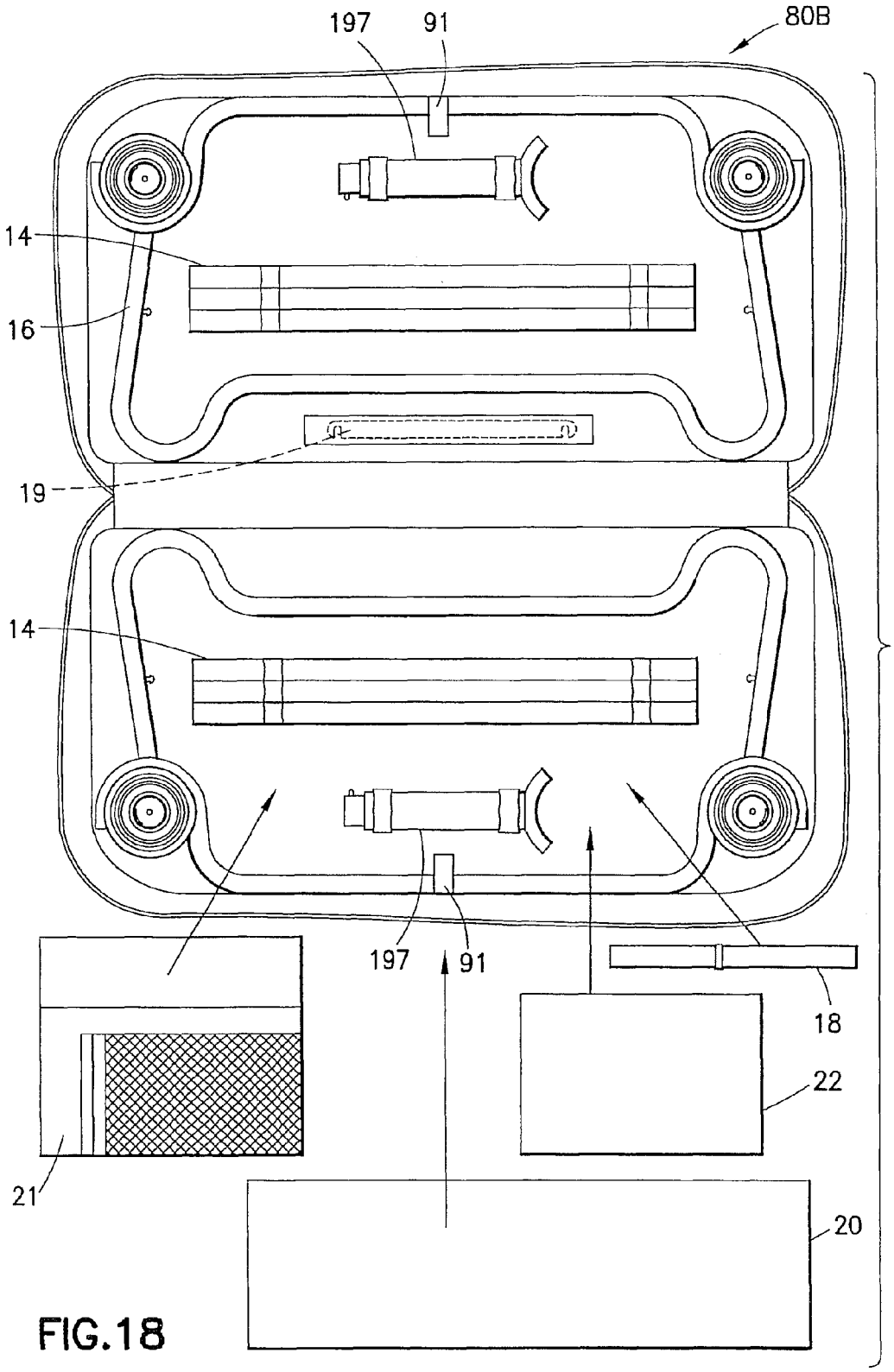
FIG. 18 is a plan view of the other carry case in the open position principally showing the lower bed assembly construction.

Referring to FIG. 18, there is shown carry case 80B. Carry case 80B is similar in overall construction to carry case 80A. However, carry case 80B retains the foot assemblies 16. The assemblies 16 are retained by means of Velcro® straps or tabs 91. Carry case 80B in a like manner to carry case 80A contains lower support members 197, an accessories pocket 21, a foot locker 20 and an integrating or locking strap 18.

In the aforesaid manner of construction, two essentially uniform construction carrying cases 80A and 80B effectively stow all the components for assembling a double-decker bed or two separate single beds. Canvas bed support 22 are separately transported or provided, as these may need to be periodically washed or replaced with extended use.

In the afore-described manner of construction, a double-decker bed or two separate single beds can be readily assembled and disassembled. While the foregoing describes a construction assembly for one double-decker bed or two single beds, it is within the contemplation of the present invention to provide further expanded construction assemblies such as for a triple-decker bed.

The foregoing description is intended to be merely illustrative and not limiting of the invention, which invention is defined by the adjoined claims.

The invention claimed is:

1. A kit for a portable assembly bed, said kit comprises:

a carry bag, said bag comprises a carry grip and inner and outer surfaces;

bed construction components comprising cooperative means for assembly of the components, said components comprise pre-assembled tubular frames and discs which components when assembled provide a bed for supporting at least one person;

retaining elements disposed on the carry bag inner surfaces for removably retaining the bed construction components;

whereby with the construction components retained in the carry bag a user grips the carry grip and readily transports the kit to a location for removal and assembly of the construction elements to provide the bed.

2. The kit of claim 1, further comprising a second carry bag, said first and second kits comprises first and second cooperative bed construction components, and means for assembling of the first and second bed constructions, whereby the first and second carry bags are carried to a location and the first and second components assembled to provide a double-decker bed comprising an upper bed and a lower bed for supporting at least two persons.

3. The kit of claim 2, said kit further comprises at least one folded construction, which folded construction when unfolded comprises a foot locker for disposition below the lower bed.

4. The kit of claim 2, said carry bag comprises a flexible material construction.

5. The kit of claim 1, said pre-assembled frames and discs comprise a head assembly frame and foot a assembly frame.

6. The kit of claim 2, said bed comprises a double-decker cot, and said assembly further comprises a knocked down foot locker, said knocked down foot locker being disposed in one of the carry bags, and wherein with the cot assembled, the foot locker is disposed under the lower cot.

7. A kit for a portable assembly bed, said kit comprises:

a carry bag, said bag comprises a carry grip and inner and outer surfaces;

bed construction components comprising cooperative means for assembling the components, which components when assembled provide a bed for supporting at least one person;

retaining elements disposed on the carry bag inner surfaces for removably retaining the bed construction components;

further comprising a second carry case, said bed comprises a double-decker cot having an upper cot and a lower cot, said components being disposed in the two carry cases, said components comprise a plurality of tubular frame members and a plurality of discs for operably connecting the tubular frame members, and further comprising two flexible material body support mats, and means for connecting the frame members, discs and the flexible mats to construct the double-decker cot;

whereby with the construction components retained in the carry cases a user grips the carry grips and readily transports the kit to a location for removal and assembly of the construction components to provide the double-decker cot.

8. The kit of claim 7, said tubular frame members further comprise two unitary frame members comprising respective lower cot support legs.

9. In combination:

an assembled bed comprising cooperatively assembled discs and tubular frame members; and a foot locker construction comprising a top, a bottom and four sides, two sides being facingly disposed and inwardly foldably disposed, and said foot locker further comprises an unfolded construction and a folded flat construction, said facingly disposed sides being folded inwardly in the folded flat construction, said unfolded construction foot locker being operably disposed beneath the bed, and said folded construction foot locker being in a flat disposition for ready storage and transport.

10. The combination of claim 9, said foot locker comprises interconnected partitions disposed on the inside of the unfolded construction, said interconnected partitions being foldable from the unfolded construction to the folded flat disposition.

11. The combination of claim 9, said bed comprises a plurality of components, said components when assembled comprise a double-decker bed comprising an upper bed and a lower bed, further comprising means for detachably attaching the unfolded foot locker beneath the lower bed and further comprising two said detachably attached foot lockers disposed beneath the lower bed.

12. The combination of claim 11, at least two said components comprise one piece tubular frame members, said frame members comprising a head assembly and foot assembly.

13. The combination of claim 11, said foot assemblies comprise one piece tubular frame members comprising legs supporting the double-decker bed.

14. In combination:

(i) an assembled double-decker bed comprising a plurality of discs and tubular frame members forming an upper bed and a lower bed; and (ii) an accessories pouch, said pouch comprising means for removably attaching the pouch to one of the beds; said combination further comprises;

(iii) at least one unfolded foldable construction foot locker disposed below the lower bed and behind the pouch;

whereby with the pouch attached to one of the beds, accessories may be readily stowed in the pouch and accessed by a bed occupant.

15. The combination of claim 14, said pouch being disposed so as to hang downwardly from the lower bed.

16. The combination of claim 14, said pouch and said foot locker comprise respective flexible material constructions.

17. The combination of claim 16, said double-decker bed comprises a plurality of metal tubular frame members, two said frame components comprise one piece contoured constructions comprising legs for supporting the double-decker bed.

18. The combination of claim 16, said means for removably attaching the pouch comprises hook and loop fasteners construction.

19. The combination of claim 16, said foldable foot locker construction comprises an openable and closeable cover construction.

20. The combination of claim 16, said foot locker comprises a top, a bottom, sides and partitions connected to the bottom and disposed on the inside of the unfolded construction, and wherein said foot locker is in a flat disposition in the folded construction.

21. A kit for a portable assembly bed, said kit comprises:

a carry bag, said bag comprises a carry grip and inner and outer surfaces;

bed construction components comprising cooperative means for assembling the components, which components when assembled provide a bed for supporting at least one person;

retaining elements disposed on the carry bag inner surfaces for removably retaining the bed construction components;

and further comprising a folded foot locker, and second retaining elements disposed on the carry bag inner surfaces for removably retaining the folded foot locker;

whereby the user removes the folded foot locker from the carry bag, unfolds the folded foot locker and slidably disposes the foot locker below the assembled bed.

22. The kit of claim 21, further comprising a second carry bag, said first and second kits comprises first and second cooperative bed construction components, and means for assembling of the first and second bed constructions, whereby the first and second carry bags are carried to a location and the first and second components assembled to provide a double-decker bed comprising an upper bed and a lower bed for supporting at least two persons.

23. The kit of claim 22, in combination with;

an assembled bed comprising cooperatively assembled discs and tubular frame members; and the foot locker comprising a top, a bottom and sides and further, said unfolded foot locker being operably disposed beneath the lower bed, and said folded construction foot locker being in a flat disposition for ready storage in the kit.

24. The kit of claim 23, said foot locker comprises partitions disposed on the inside of the unfolded foot locker, said partitions being connected to the bottom, the said partitions and bottom being foldable from the unfolded construction to a folded flat disposition.

25. The kit of claim 24, further comprising means for detachably attaching the unfolded foot locker to the lower bed.

26. In combination:

an assembled bed comprising cooperatively assembled discs and tubular frame members; and a foot locker construction comprising a top, a bottom and sides, and further comprising an unfolded construction and a folded flat construction, said unfolded construction foot locker being operably disposed below the bed, and said folded construction foot locker being in a flat disposition for ready storage and transport; said foot locker construction comprises interconnected partitions disposed on the inside of the unfolded construction, said interconnected partitions being foldable from the unfolded construction to the folded flat disposition.

27. The combination of claim 26, said bottom includes the foldable partitions and being foldably disposed with respect to one side, wherein the bottom with the partitions are folded so as to be facingly disposed to the top in the folded flat disposition.

28. The combination of claim 26, said foot locker construction comprises four sides and two sides being facingly disposed and inwardly foldably disposed so as to be foldable to the folded flat disposition.

* * * * *